US005176594A

United States Patent [19]

Lee

[11] Patent Number: 5,176,594

[45] Date of Patent: Jan. 5, 1993

[54] APPARATUS AND METHOD FOR MANIPULATION OF TEMPOROMANDIBULAR JOINT

[76] Inventor: Dennis S. Lee, 1517 S. 61st St., Tacoma, Wash. 98408

[21] Appl. No.: 726,381

[22] Filed: Jul. 5, 1991

[51] Int. Cl.[5] ..... A63B 23/03

[52] U.S. Cl. ..... 482/11; 482/148

[58] Field of Search ..... 482/11, 10, 148, 111, 482/121; 433/229; 128/25 R, 52

[56] References Cited

U.S. PATENT DOCUMENTS

| | | | |
|---|---|---|---|
| 2,832,334 | 4/1958 | Whitelaw | 128/25 |
| 3,323,518 | 6/1967 | Swanson | 128/25 |
| 3,661,149 | 5/1972 | Ferries | 128/25 |
| 3,683,897 | 8/1972 | Shield et al. | 128/25 |
| 3,816,016 | 6/1974 | Schatzman | 408/11 |
| 3,824,994 | 7/1974 | Soderberg, Sr. | 128/25 |
| 3,976,057 | 8/1976 | Barclay | 128/25 |
| 4,177,804 | 12/1979 | Weingarten | 128/52 |
| 4,282,865 | 8/1981 | Pogue | 128/25 |
| 4,487,199 | 12/1984 | Saringer | 128/25 |
| 4,716,889 | 1/1988 | Saringer | 128/25 |

FOREIGN PATENT DOCUMENTS 7037360 7/1972 France .

*Primary Examiner*—Stephen R. Crow

*Attorney, Agent, or Firm*—R. Reams Goodloe, Jr.

[57] ABSTRACT

An apparatus for exercise of the temporomandibular joint. The apparatus consists of a maxillary mold attachment means pivotally attached to pins which are inserted to a stationary portion of an actuation device, and a mandibular mold attachment means pivotally attached to pins which are inserted to the traveling portion of an actuation device. The actuation device provides vertical motion to exercise the joint. The attachment means includes extension means including a hollow cylinder and a piston to accommodate the required horizontal displacement of the jaw during opening and closing, the pivot means to accommodate the curvelinear motion of the jaw when opening and closing. A method of therapy using the disclosed device provides improved bite gap for patients undergoing TMJ surgery.

18 Claims, 6 Drawing Sheets

APPARATUS AND METHOD FOR MANIPULATION OF TEMPOROMANDIBULAR JOINT

TECHNICAL FIELD OF THE INVENTION

This invention relates to novel, improved devices for manipulating an animal joint after surgery, and more particularly to improved dental attachment devices which may be used in combination with an actuator apparatus providing a rhythmic reciprocating movement, in order to flex the human temporomandibular joint. Devices of that character are particularly useful for exercising the temporomandibular joint after surgery on the joint, and such devices will for the most part be referred to herein as temporomandibular joint (TMJ) manipulation apparatus. A method of employing the device to treat TMJ surgery patients is also disclosed.

BACKGROUND OF THE INVENTION

The human temporomandibular joint is a rather complex joint that must function in a coordinated way if troublesome derangements are to be avoided. Situated just in front of the ear, it consists of a condyle at the upper end of the mandible that fits into the condylar fossa on the lower part of the temporal bone of the skull, and a meniscus (articular disk) interposed between the condyle and the articulating surface of the temporal bone. The mandible, the large heavy bone of the lower jaw, is shaped rather like a horseshoe and pivots about the articulating disk in a gliding, hinge like motion.

The temporomandibular joint is susceptible to a variety of problems, some of which may be corrected by exercise therapy, and others which may require surgical techniques. The latter course of treatment gives rise to the need for post-surgical manipulation in order to preserve or enhance operation of the joint. In the past, therapeutic treatment of the temporomandibular joint by flexing the joint has been primarily provided by manual flexure of the joint performed by a nurse, physical therapist, or by exercise done by the patient.

Generally in medical treatment, there have been developed a variety of devices which may be utilized to some limited extent to induce motion in a human joint. With respect to joints other than the temporomandibular joint, a number of such devices are known. In the patent literature, U.S. Pat. No. 4,487,199 issued Dec. 11, 1984 to Saringer for DEVICE FOR IMPARTING CONTINUOUS MOTION TO HUMAN JOINTS, and U.S. Pat. No. 4,716,889 issued Jan. 5, 1988 to Saringer, with the same title, are the closest art of which I am aware. Other patents of which I am aware include devices for imparting motion to joints include U.S. Pat. No. 2,832,334 issued Apr. 29, 1958 to Whitelaw for THERAPEUTIC DEVICE FOR USE IN MANIPULATIVE TREATMENT OF JOINTS OF THE HUMAN BODY; U.S. Pat. No. 3,683,897 issued Aug. 15, 1972 to Shield et al for APPARATUS FOR MOVING OR ACTIVATING PARTS OF THE BODY; U.S. Pat. No. 3,976,057 issued Aug. 24, 1976 to Barclay for JOINT FLEXING APPARATUS; and French Patent No. 70.37360 to Cabinet Malemont for APPAREIL DE MOBILISATION CONTINUE DES DOIGTS POUR PREVENIIR LES ANKYLOSES CONSECUTIVES AUX TROUBLES TROPHIQUES POST-TRAMATIQUES OU INFECTIEUX.

For the most part, the patent documents identified in the preceeding paragraph disclose devices which include only linear motion, or accommodate pivotal motion via means which are unsuited for adaptation to the temporomandibular joint.

The closest prior art device for exercises of the temporomandibular joint of which I am aware is a device known as the "Mobilimb J1—TMJ CPM," sold by Toronto Medical Corporation of Canada. The Mobilimb device is comprised of an actuation portion which includes a battery powered mechanical drive unit to provide an adjustable range of reciprocating linear motion, and a pair of dental mold attachment portions which are adapted to fit dental impression molds. However, the Mobilimb J1 device as presently utilized includes dental mold attachment portions which fail to accommodate the fact that the front portion of a human mandible moves in an arc, rather than merely vertically, when the jaw is opened. Thus, the Mobilimb device, due to the defects in the dental mold attachment portions as have been developed and used heretofore, fails to track the actual pattern of movement of a human mandible.

Unlike the actual movement of a human jaw, which traverses an arc from the pivot point of the temporomandibular joint, the presently used dental mold attachment portions of the Mobilimb J1 device provide only vertical motion, as will be further described hereinbelow. Thus, the present attachments to the device are deficient in that they fail to provide for the simultaneous forward to rearward movement and the pivotal, curvelinear motion of the bottom of a jaw as it is opened. Thus, there exists a continuing need in the art for an improved method of providing an exercise device for the temporomandibular joint which provides motion which corresponds to the natural movement of the jaw as it is opened and closed.

SUMMARY OF THE INVENTION

I have now invented, and disclose herein, a novel temporomandibular joint (TMJ) manipulation system which is like those heretofore proposed in that it accommodates vertical motion of a mandible in response to a vertical manipulative motion. However, my novel system varies from those of this type heretofore proposed in that it also provides both a horizontal and pivotal adjustment in response to pivotal motion of a mandible upon manipulation thereof. Additionally, my invention provides a pivoted attachment for a maxillary dental mold, so that patients can use my device even if their maxillary plane compensation curve (the plane formed by the bottom of the upper teeth) may be offset from the horizontal. In addition, my device is simple, relatively inexpensive, easy to manufacture, serviceable for the duration of a typical patient care period, and otherwise superior to the heretofore proposed systems.

In general, the TMJ manipulation device employing the principles of the present invention include (1) a relatively thin mandibular dental impression or mandibular mold attachment means, (2) a relatively thin maxillary dental impression or maxillary attachment means, both of which are used in combination with a suitable actuation device, such as the actuator portion of the Mobilimb J1—TMJ CPM apparatus. Both the mandibular dental mold attachment means and the maxillary dental mold attachment means of my invention are oriented to cover a portion of a patients teeth in a custom, closely fitting fashion in which the mold attachment means provides a relatively secure attachment to the teeth. At each side of each mold, at an exterior position normally adjacent the patient's first bicuspid, a pivot means is provided as an attachment point to a cylinder and piston extension means. The pivot means allows the forward and rearward portion of each mold to move upward or downward about the pivot means and thus enables curvelinear movement of the mold to take place.

Additionally, the lower or mandibular dental mold attachment means includes an extension means which has a piston and cylinder assembly having one end pivotally connected to the above mentioned pivot means. An extension means is normally provided on both sides of the mandibular mold. This extension means is important since it allows the needed horizontal movement of the mandibular dental mold attachment means (forward to rearward of the patient on opening the jaw and the reverse on closing) during a cycle of flexing of the temporomandibular joint.

Further, my device provides a biasing means which urges the mandibular dental mold attachment means toward a normally closed position. The attachment means is biased toward the closed position by a rubber band of appropriate size and length which is preselected to provide the desired closing force. That rubber band also has the desired property of being insensitive to saliva present in the mouth, and additionally avoids the potential for gum damage that might be posed by use of, for example, a steel spring or similar less desirable device.

OBJECTS, ADVANTAGES AND FEATURES OF THE INVENTION

From the foregoing, it will be evident to the reader that the primary object of the present invention resides in the provision of a novel, improved apparatus for manipulation of the temporomandibular joint in a manner which replicates the natural motion of the mandible when opening and closing.

It is a further object of the present invention to provide a TMJ manipulation device which has vertical and horizontal adjustment mechanisms which are capable of compensating for changing alignment between a mandible and a motion providing actuator during use.

It is a still further object of the present invention to provide a TMJ manipulation device which has pivotally adjustable dental impression molds attachment means to: (1) allow adjustment between a maxillary mold attachment means and actuator, (2) allow adjustment between a mandibular mold attachment means and an actuator, and (3) accommodate the natural pivotal and gliding motion of a mandible as it is opened and closed by the TMJ manipulation apparatus.

Other also important but more specific objects of the invention reside in the provision of TMJ manipulation apparatus in accord with the preceeding objects:

which allow one to preselect the amount of force incorporated in the aforementioned biasing means in the maxillary mold attachment means to achieve an appropriate urging force toward closing;

which is capable of resisting deterioration by corrosion or erosion during use;

which is rugged and durable;

which, in conjunction with appropriate actuators, can be operated at any desired speed at the option of the operator to facilitate the setting up, testing, and physical therapy program for a patient;

which is easy to install and remove;

which is capable of automatic operation by a patient; and, which, in conjunction with the preceeding objects, is so designed that the apparatus provides a method of improving the post-operative bite capabilities of patients undergoing jaw surgery.

While the present invention is generally described with reference to and as an improvement of the earlier process of manipulation of the mandibular joint by the Mobilimb J1—TMJ CPM apparatus, it should be understood that alternate actuator apparatus may be suitable for utilization of the dental mold attachment means that I have invented and disclose herein.

My invention is advantageously employed in TMJ surgery rehabilitation in that it is an improvement over the earlier devices of which I am aware. It includes the utilization of a mandibular dental impression having secured thereto at a predetermined location a pivot means and an extension means horizontal, vertical, and pivotal motion on manipulation of the mandible, rather than vertical motion alone. That is, on opening, my manipulation device allows the mandible to move both downward and rearward, and on closing, allows the mandible to move upward and forward, relative to the patient.

Other important objects, features and additional advantages of the invention will be apparent to the reader from the foregoing and the appended claims and as the ensuing detailed description and discussion of the invention proceeds in conjunction with the accompanying drawing.

DETAILED DESCRIPTION OF THE INVENTION

Figure 1:
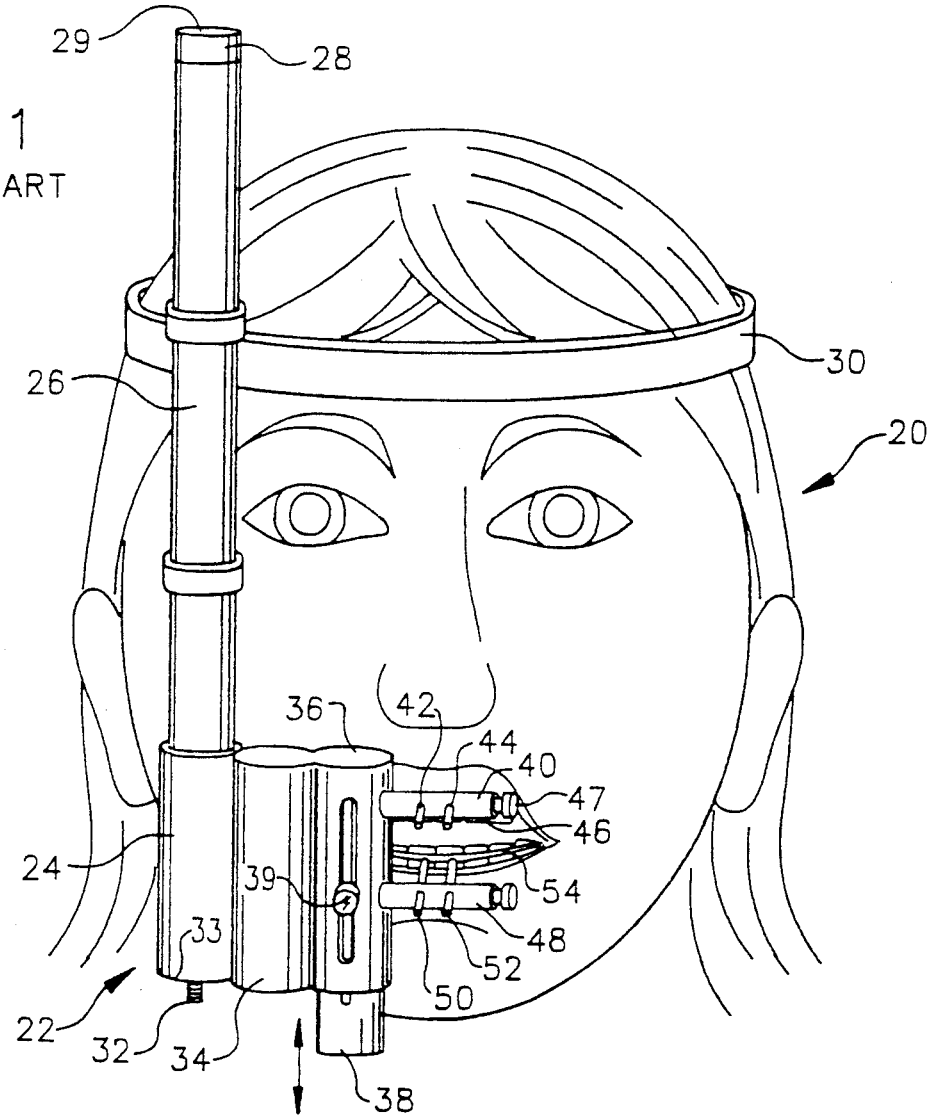
FIG. 1 PRIOR ART
FIG. 1 is a front pictorial view of a patient equipped with a prior art temporomandibular joint manipulation actuator known as the Mobilimb J1—TMJ CPM.
Figure 2:
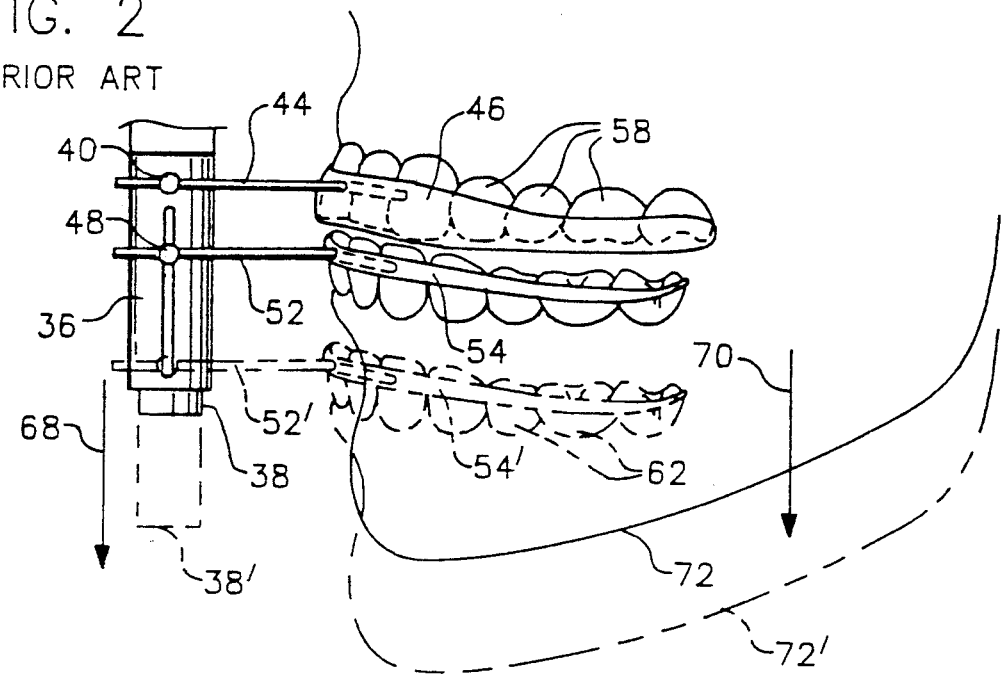
FIG. 2 PRIOR ART
FIG. 2 is a side view of a prior art manipulation actuator and accompanying dental mold attachment portions as found in the Mobilimb J1 actuator and attachments.

Turning now to the drawing, FIGS. 1 and 2 depict a patient 20 wearing a prior art actuator device 22. The actuator device 22 has a base 24 which may be provided with an extension portion 26, which portion may allow for storage of batteries (not shown) therein and have a battery cap 28 at the top 29. Positioning means 30 secures the actuator 22 to patient 20 and helps to minimize movement of the base 24 relative to the patient 20. Base 24 includes an on-off switch 32 at the bottom 33 and a housing 34 for a motor drive unit (hidden in housing 34). The base 24 has a fixed vertical portion 36 and a traveling portion 38 which may move up and down relative to the fixed vertical portion 36 as provided by suitable energizing means such as the battery powered gear drive mechanism (as shown, hidden inside housing 34).

Extending from the fixed vertical portion 36 is a fixed securing means 40 which allows insert pins 42 and 44 from a first maxillary dental mold 46 (best seen in FIG. 2) to be secured thereto. Friction means 47 enables pins 42 and 44 to be tightened with respect to securing means 40 so as to prevent movement of the pins 42 and 44. Similarly, extending from the traveling portion 38 is a traveling securing means 48 which allows insert pins 50 and 52 from a mandibular dental mold 54 to be secured thereto. As with the fixed securing means 40, the traveling securing means 48 includes a friction means 55 which enables pins 50 and 52 to be secured with respect to the traveling securing means 48 so as to prevent movement of the pins 50 and 52.

Thus, it can be seen that the maxillary dental mold 46, attached by pins 42 and 44, is held in a fixed position relative to the fixed vertical portion 36 of base 24. Also, the mandibular dental mold 54 is allowed to move only up and down along with traveling portion 38.

Turning now to FIG. 2, the difficulties encountered by this prior art device are further illustrated. A maxillary mold 46, adapted to tightly fit a patient's upper teeth 58 is rigidly attached to a fixed securing means 40 by way of pins 42 and 44. The pins project forward exactly at the angle at which they are affixed to the mold 46. If for any reason the fixed securing means 40 does not align exactly with pins 42 and 44, no adjustment is possible.

Moreover, in the prior art device shown in FIG. 2, a mandibular mold 54, adapted to tightly fit a patient's lower teeth 62 is rigidly attached to traveling securing means 48 by way of pins 50 and 52, in a manner which only allows for downward motion indicated by arrow 68 at the traveling portion 38. While this corresponds to the downward motion indicated by arrow 70 at the jaw 72, it does not allow for the curvelinear motion of the jaw 72 when opening. Thus, the prior art device attempts to move the jaw 72 downward toward the position indicated by reference numeral 72' when the traveling portion 38 moves toward position 38'. As neither horizontal movement or rotational change is allowed between the maxillary mold 46 and the mandibular mold 54, this prior art approach has been unsuccessful in providing the desired results in patients who need a suitable temporomandibular joint manipulation device.

Figure 3:
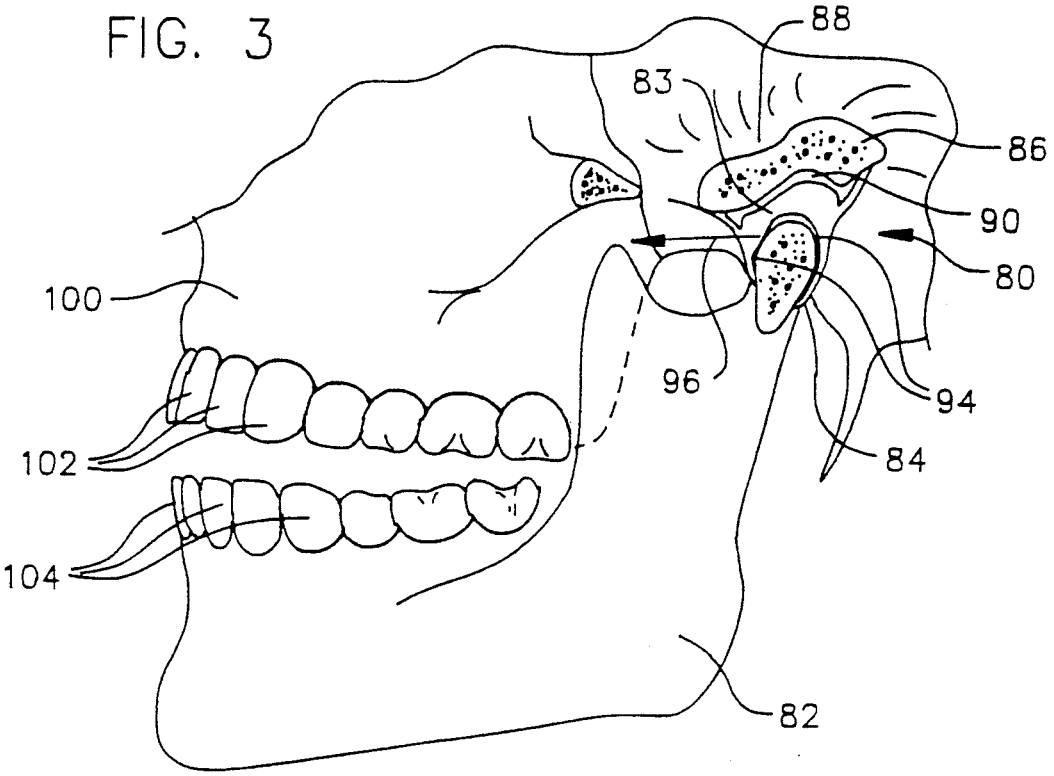
FIG. 3 is a side view of a slightly opened human temporomandibular joint, where hinge action of the joint can be seen.
Figure 4:
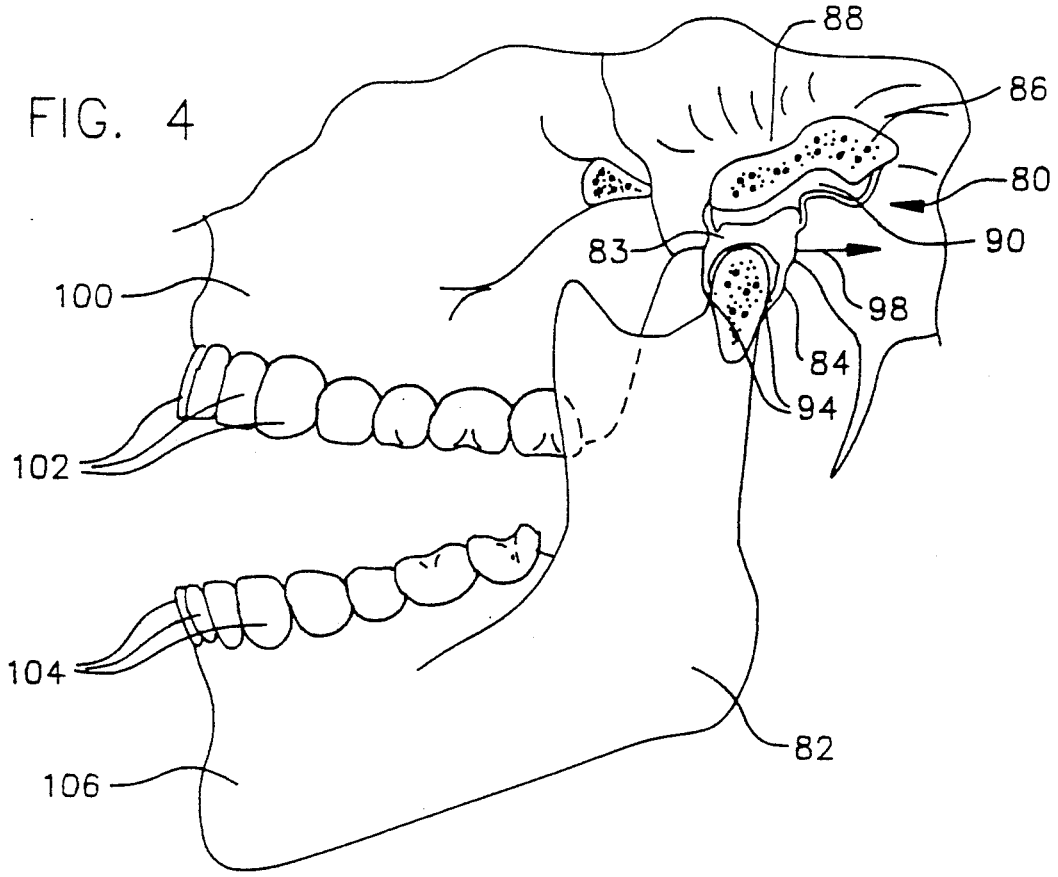
FIG. 4 is a side view of a widely opened human temporomandibular joint, where both hinge action and gliding action of the joint can be seen when compared to the above FIG. 3.

Turning now to FIGS. 3 and 4, a simplified anatomical illustration of the human temporomandibular joint 80 and related structures is provided by way of a partial diagrams of the human skull. From these two views, the reader will be able to see the complex motion presented by movement of a mandible 82 about the temporomandibular joint 80, and thus appreciate the problems solved by the apparatus and method of the present invention.

The human temporomandibular joint ("TMJ") 80 is situated just in front of the ear (not shown). A condyle 84, being the rounded upper end of the mandible 82, inserts into a condylar fossa or receptacle cavity 83 below the articular tubercle 86 at the lower part of temporal bone 88 of the skull. An articular disk or meniscus 90 is interposed between the condyle 84 and the articulating tubercle 86. The TMJ 80 is centered at a joint capsule 94 that allows the joint to pivot with hinge like motion below the articular disk 90.

In addition to the hinge like motion just described, the articular disk 90 (and accompanying joint capsule 94) moves forward in the direction of arrow 96 as the mandible 82 is moved from a closed toward an open position, as may be seen by comparing the slightly open position illustrated in FIG. 3 with the widely opened diagram of FIG. 4. When the mandible 82 is moved from an open position to a closed position, the articular disk 90 moves rearward, as indicated by reference arrow 98. Thus, it can be seen that the location of the hinge or pivot point provided by the articular disk 90 changes as a jaw is opened and closed.

In addition to the TMJ location and function just described, these FIGS. 3 and 4 show the location of the maxilla or maxillary bone 100 of the skull, to which are attached the upper teeth 102. Similarly, the lower teeth 104 are attached to the body 106 of mandible 82.

Figure 5:
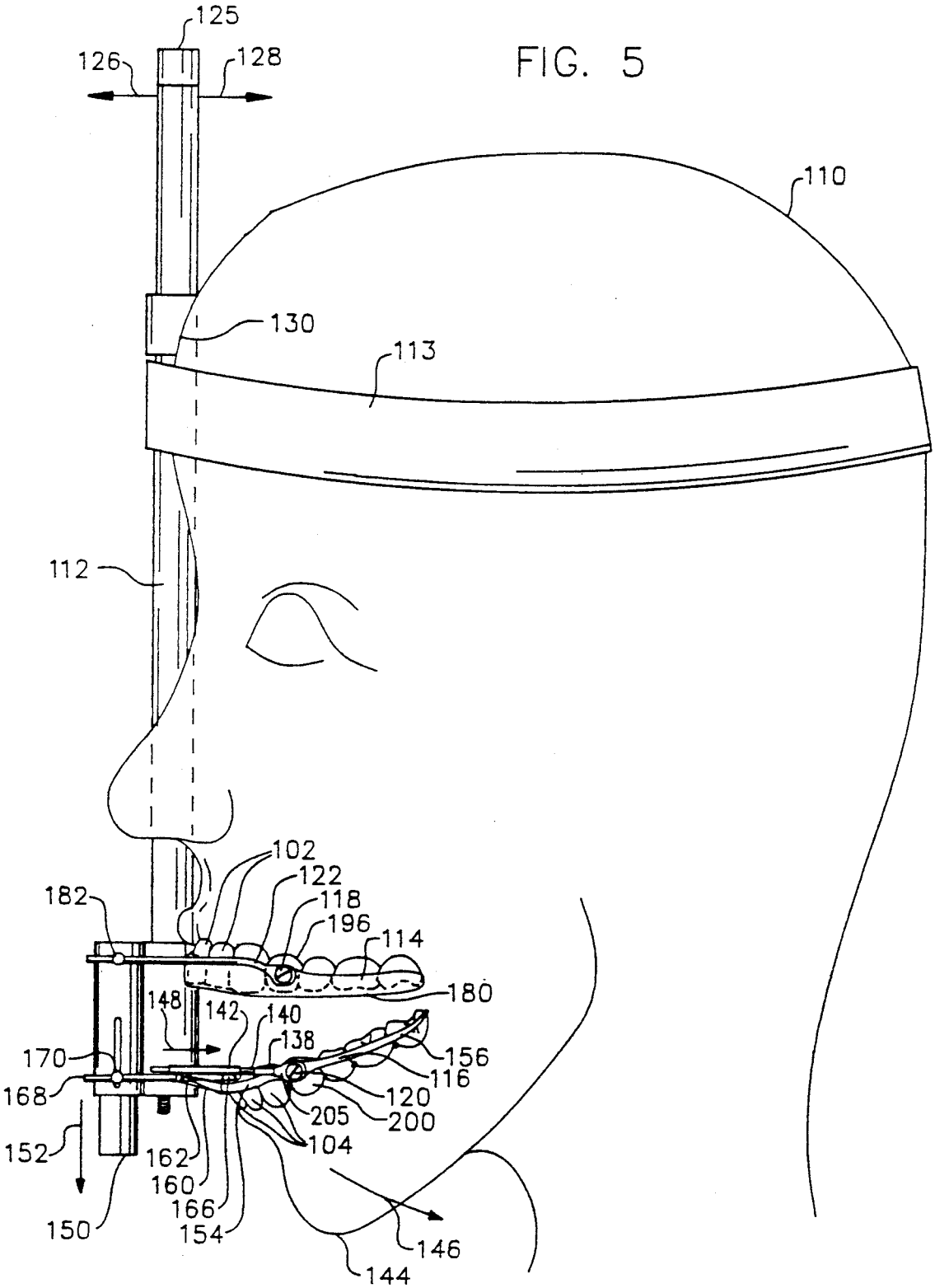
FIG. 5 is side view of the temporomandibular joint manipulation device of the present invention, including a maxillary dental impression mold attachment means, a mandibular dental impression mold attachment means, pivot means, extension means, and associated components, as well as an actuator means for providing a disengaging and reengaging motions between the maxillary and mandibular attachment means.

Attention is now directed to FIG. 5, where the improved apparatus that I have invented is shown. A patient 110 is wearing an actuator device 112 which is secured to the patient by positioning means 113. The actuator device 112 is adapted to provide vertical motion between a maxillary dental mold attachment means 114 and a mandibular dental mold attachment means 116.

The operation of the actuator 112 itself is as described above in FIG. 1 for the Mobilimb J1 device, if used, or may vary slightly if other types of actuators 112 are utilized. In any event the upper or maxillary mold attachment means 114 is securely affixed to the actuator 112 in a stationary position by its mounting pins 122 and 122-r, and the the bottom or mandibular mold attachment means 116 is securely affixed to the vertically moving portion 150 of the actuator 112 by to its mounting pins 168 and 168-r, so that reciprocating vertical movement can be imparted between the stationary maxillary mold attachment means 114 and the moving mandibular mold attachment means 116.

Unlike those molds known heretofore, both my maxillary dental mold attachment means 114 and my mandibular dental mold attachment means 116 include a pivot points, designated as pivots 118 and 120 respectively in this view of the left side of the devices. Pivot point 118 on the maxillary mold attachment means 114 allows the attachment means 114 to freely pivot with respect to securing pins 122 (shown here) and 122-r (seen in FIG. 9). Another advantage provided by pivot point 118 on the maxillary attachment means 114 is that the upper end 125 of actuator device 112 may be moved forward as indicated by the arrow referenced as 126, or rearward as indicated by the arrow referenced as 128, without a corresponding disengagement of the mold attachment means 114 from the upper teeth 102, as, for example, occurs with the prior art device set forth in FIG. 2 above.

The ability to move the actuator device 112 forward and rearward is important since it helps accommodate patients 110 with differing head geometry. For example, patients may have foreheads 130 which extend to various forward dimensions when compared to the position of upper teeth 102 to an extent not easily accommodated solely by the adjustment of pins 122 and 122-r at fixed securing means 182 of the actuation device 112.

A limitation such as that just discussed which is inherent in prior art devices known to me can be better envisioned with reference to FIGS. 1 and 2 above, particularly in FIG. 2 wherein the mold 46 is held at a constant angle with respect to actuator 22 by pins 42 and 44. Also, it can be seen in FIG. 2 that pins 42 and 44 must be mounted at exactly the right position with respect to mold 46 so that the actuator 22 can be secured to a patient, unlike in my novel development illustrated in this FIG. 5 wherein it is unnecessary to worry about the desired angle between mold attachment means 114 and pins 122 and 122-4, since the angle between the pins 122, 122-r and mold attachment means 114 is totally adjustable about the pivot 118.

Again referring to FIG. 5, some important details of my novel mandibular mold attachment means 116 are shown. Attached to pivot 120 is an extension means 138 which includes a rod shaped probe or piston 140 which inserts through a hollow cylinder 142 so as to provide a guide for the rearward motion of mold attachment means 116 upon opening of the jaw 144 as indicated by the direction of arrow 146. As the jaw 144 opens, the piston 140 moves rearward, as indicated by arrow 148, as the traveling portion 150 of actuator 112 moves downward as indicated by arrow 152.

The front 154 of mandibular mold attachment means 116 pivots downward and the rear 156 of mandibular mold attachment means 116 pivots upward about pivot 120. Thus it can be seen that the mandibular attachment means 116 is allowed to move horizontally via extension means 138 as well curvelinearly about the pivot 120 so as to accommodate the natural motion of jaw 144 as described above with reference to FIGS. 3 and 4.

In order to easily close jaw 144 for the patient 110, there is provided a biasing means 160 which is connected between the front 154 of mandibular attachment means 116 and the center 162 of the Y-portion 164 (see FIGS. 10 and 11 below) of attachment means 116. This biasing means 160 may be provided in the form of a rubber band of preselected length, size, and strength. I have found that a number 30 rubber band, two inches (2") in length, one-eighth inch ($\frac{1}{8}$") width, and one-thirtysecondth (1/32") gage, as manufactured by the Plymouth Rubber Company of Canton, Mass., U.S.A., will provide a desirable biasing means 160 when installed as described herein. The biasing means 160 urges the front 154 of attachment means 116 upward when the front 124 is pivoted downward, so that the mandibular attachment means 116 is urged to return toward a jaw closed position. This is extremely helpful in that the patient 110 does not have to exert force to enable the jaw 144 to close.

Cylinders 142 of extension means 138 are attached to the upper distal end 166 the Y-portion 164 of mandibular attachment means 116. The proximate end 168 of Y-portion 164 is a pin suitable for insertion into the traveling portion securing means 170 of actuator 112, to securely attach the mandibular attachment means 116 to the actuator 112.

It is to be understood that although my apparatus has just been described with respect to a left side view, substantially identical parts can and normally are provided on the right side of my maxillary mold attachment means 114 and my mandibular mold attachment means 116 (as will be seen below). Although it may be possible to construct either attachment means using connections only on one side, I consider it preferable to utilize both left and right side components to minimize uneven application of forces and to provide additional strength to the devices.

In the remainder of the Figures, like numbers will be used for like parts without repetitive description thereof. Where left side parts have been heretofore described, similar parts for the right side may be noted with the same reference numeral followed by the suffix "−r."

Figure 6:
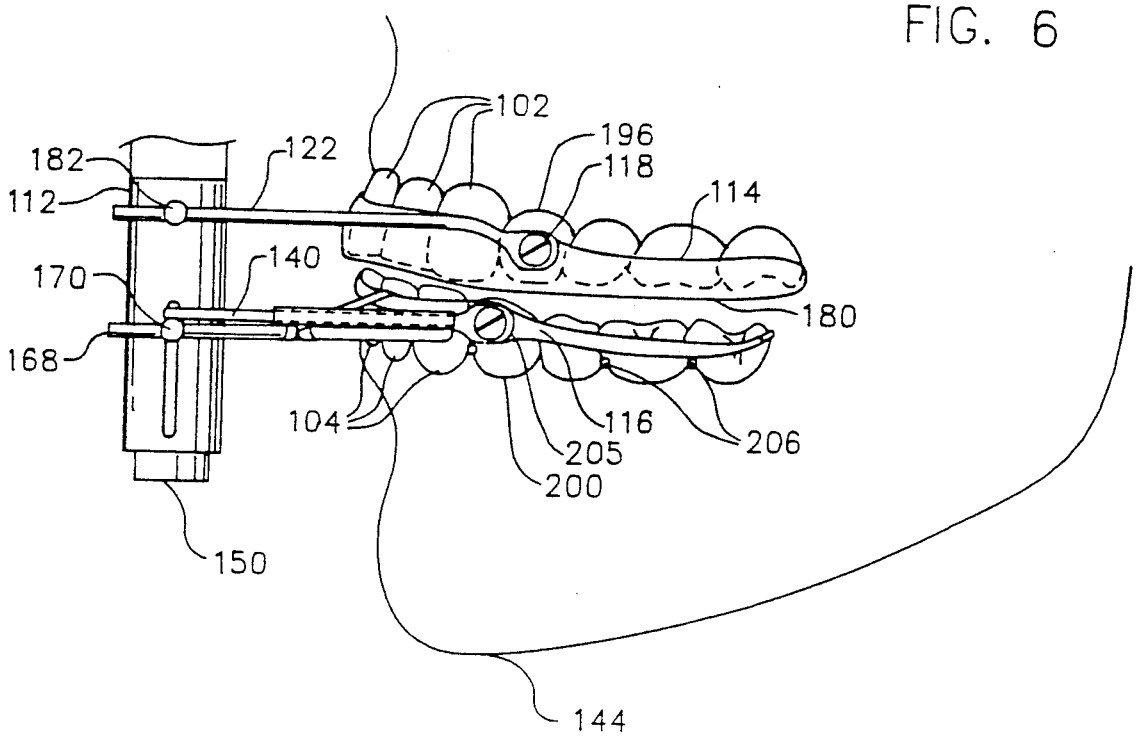
FIG. 6 is a side view of a slightly open jaw, showing an enlarged portion of the view just shown in FIG. 5, to better show the detail of the extension means and biasing means of the present invention.

FIG. 6 shows the position of the mandibular mold attachment means 116 when the jaw 144 is nearly closed. As pointed out below with respect to the maxillary attachment means 114 and the mandibular attachment means 116, it is important to construct both molds with adequate gaps and clearance so that the upper teeth 176 may approach the lower teeth 178 as closely as possible. Normally, the plastic maxillary mold 114 will be fabricated so as to have a lower surface 180 thickness not exceeding 2 mm. The mandibular mold 116 is constructed with openings 182 therethrough (See FIGS. 10 and 11) so that the lower teeth 104 protrude through the mold attachment means 116 and contact the plastic lower surface 180 of the maxillary mold 114.

Also seen in FIG. 6 is the pin 122 which is secured to fixed securing means 182 to securely fasten the maxillary mold 114 to the actuator 112.

Figure 7:
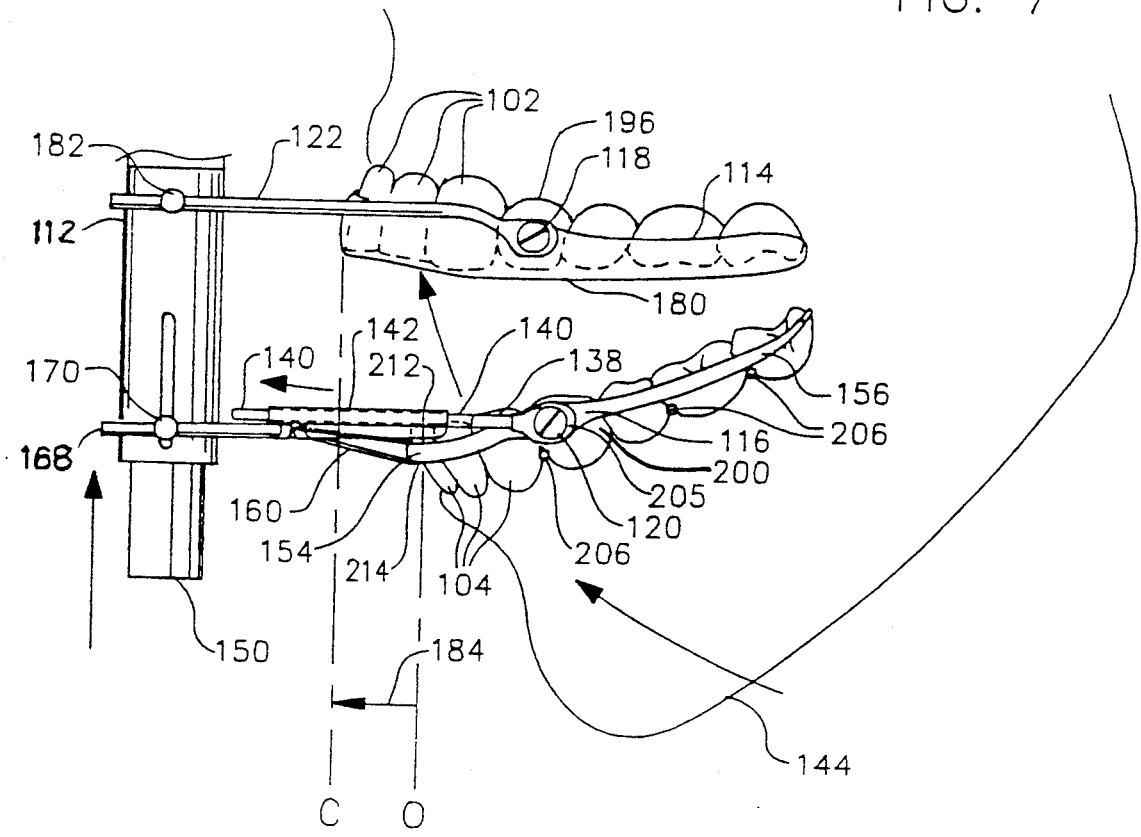
FIG. 7 is a side view of an open jaw similar to FIG. 6, here illustrating the movement of the TMJ manipulation apparatus during closing of the jaw wherein forward movement occurs, as allowed by the extension means, and upward and pivotal movement of the mandible occurs, as allowed by the pivot means.

In FIG. 7, the action of mandibular attachment means 116 when closing the jaw 144 can be seen. The required horizontal displacement is indicated by the reference arrow 184 between reference line 0 an reference line C. This horizontal, rearward to frontward displacement is accommodated by the inward movement of piston 140 through hollow cylinder 142. The movement is assisted by biasing means 160 which tends to bring the attachment means 116 toward the closed position.

Figure 8:
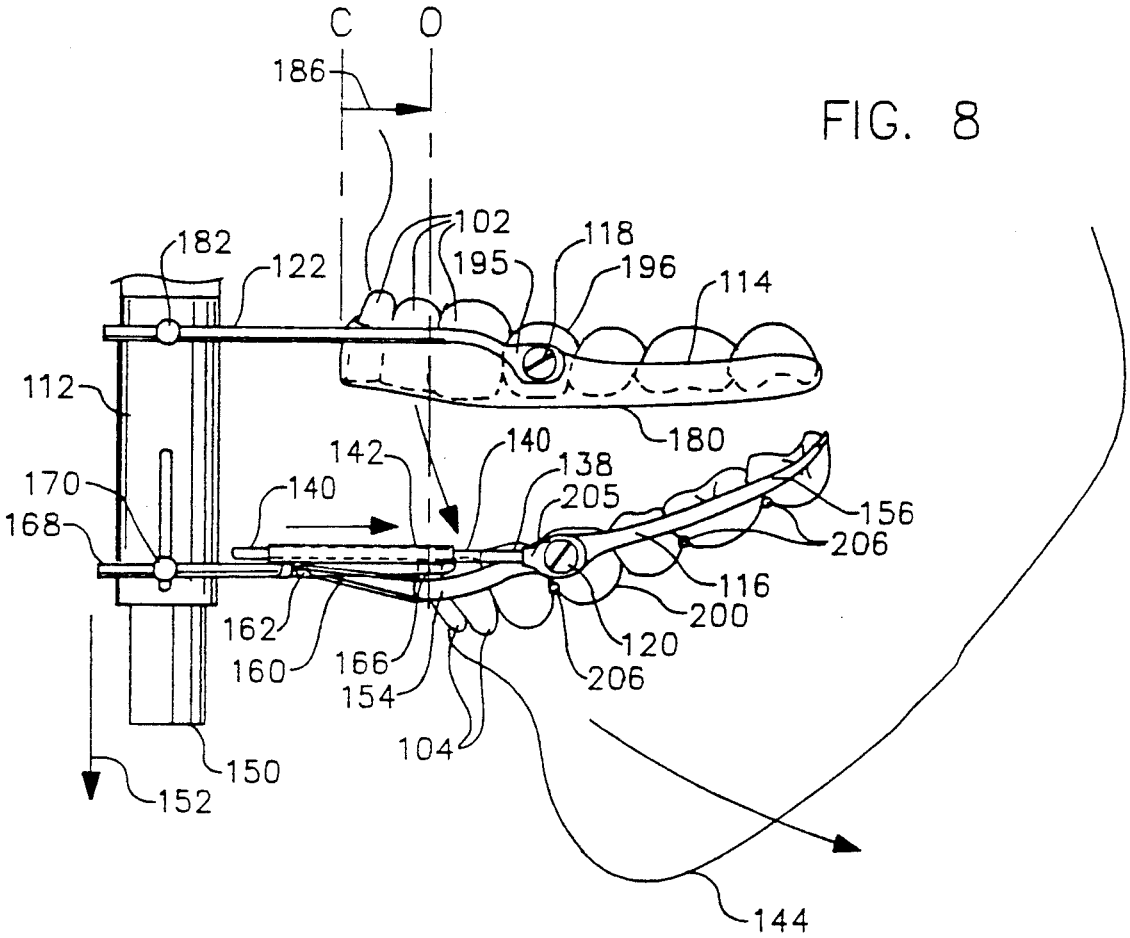
FIG. 8 is a side view similar to FIG. 7, here showing the TMJ manipulation apparatus employed during a cycle of opening a jaw wherein rearward movement occurs as allowed by the extension means, and downward and pivotal movement occurs as allowed by the pivot means.

Similarly, in FIG. 8, the action of the mandibular attachment means 116 when opening the jaw 144 is noted. The required horizontal displacement is indicated by the reference arrow 186 between reference line "0" (for open) and reference line "C" (for closed). This horizontal, forward to rearward movement is accommodated and directed by the outward movement of piston 140 through hollow cylinder 142. Also, the curvelinear movement of the front end 154 and rear end 156 of means 116 is enabled by pivot 120, about which the mandibular attachment means 116 rotates.

Figure 9:
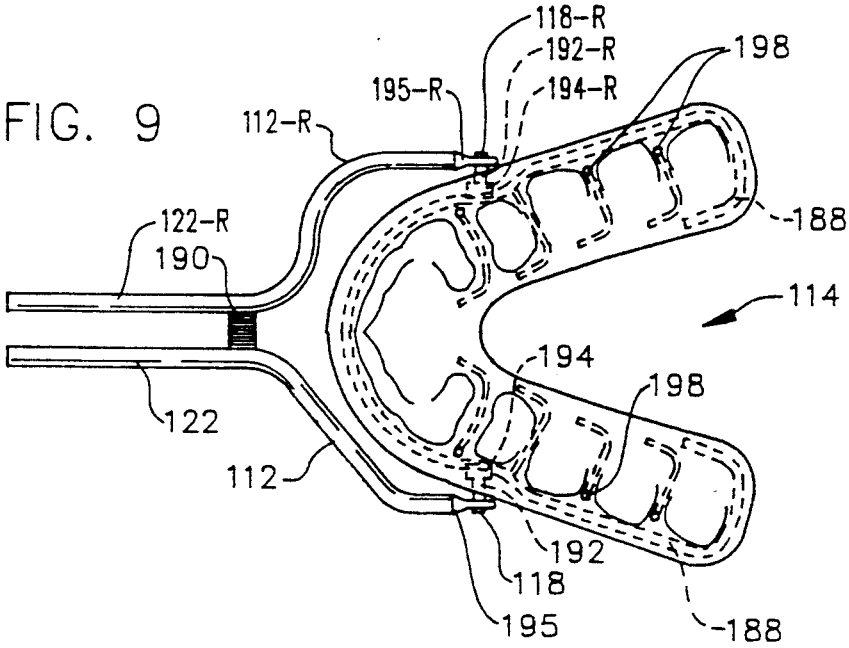
FIG. 9 is a top plan view of the maxillary impression mold attachment means of the present invention which provides a pivot means on each side of the mold.

Turning now to FIG. 9, there is shown a top plan view of the maxillary mold attachment means 114. The mold 114 is normally constructed out of orthodontic grade acrylic plastic in a customized fashion for each patient. The upper or maxillary mold 114 is normally provided with a solid lower surface 180, in contrast to the openings 182 provided for teeth in the mandibular attachment means 116. Reinforcement 188 throughout both mold attachment means 114 and mold attachment means 116 is provided by 0.036 inch (0.036") stainless steel orthodontic round wire. All joints, such as the central connection 190, are completed by use of construction materials safe and suitable for placement in a patient's mouth, such as silver soldering.

The pivot pins 118 and **118-*r* are provided by way of a screw 192 and a threaded receptacle 194 which is embedded in the mold attachment means 114. The screws 192 or 192-*r* are inserted through eye 195 or 195-*r* respectively in the distal ends of pins 122 or 122-*r*. The location for the pivot pins 118 and 118-*r* are normally adjacent to the first bicuspid tooth 196 (on each side see FIG. 8). The attachment of the mold 114 to the upper teeth 102 is provided by way of ball clasps 198**; I have found it useful to provide at least three per side.

Figure 10:
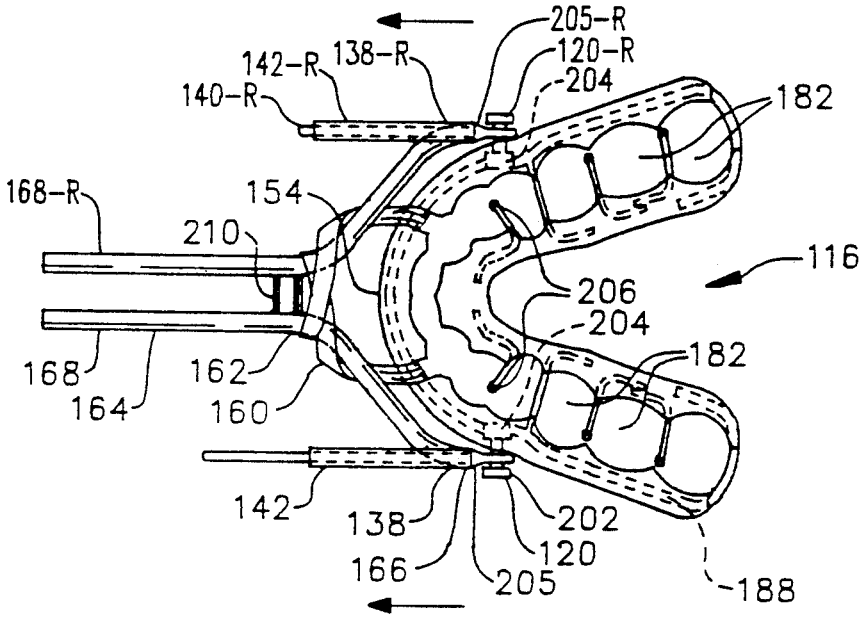
FIG. 10 is a top plan view of the mandibular impression mold attachment means of the present invention, illustrating the operation of the device during closure of the mouth with upward, inward movement, with the device here shown at its most forward position.

Turning now to FIG. 10, the mandibular mold attachment means 116 is shown from a top plan view. Openings 182 are provided for lower teeth 104 to protrude upward through the mold attachment means 116. Location of the pivot pins **120 120-*r* are provided adjacent to the first bicuspid tooth 200 (See FIG. 6). The pivots are provided similarly to the method in the maxillary mold attachment means 114 by use or a screw 202 and a threaded receptacle 204. The screws 202 or 202-*r* are inserted through eye portions 205 or 205-*r* respectively in the ends of pistons 140 or 140-*r*. Also, the mandibular mold is affixed to lower teeth 104 by way of ball clasps 206. The pins 168 and 168-*r* are joined by a central joint 210**, preferably constructed of silver solder.

The biasing means—rubber band 160 is seen at the front 154 of the attachment means 116. As can be seen by comparison of FIGS. 7 and 11, the band 160 folds over the top 212 and bottom 214 of the front 154 of attachment 116, and thence is sent under the Y portion of pin 168 and thence is twisted over same as is evident in FIGS. 10 and 11. This method of construction provides a continuous rubber band 160 that is of desired biasing strength.

Figure 11:
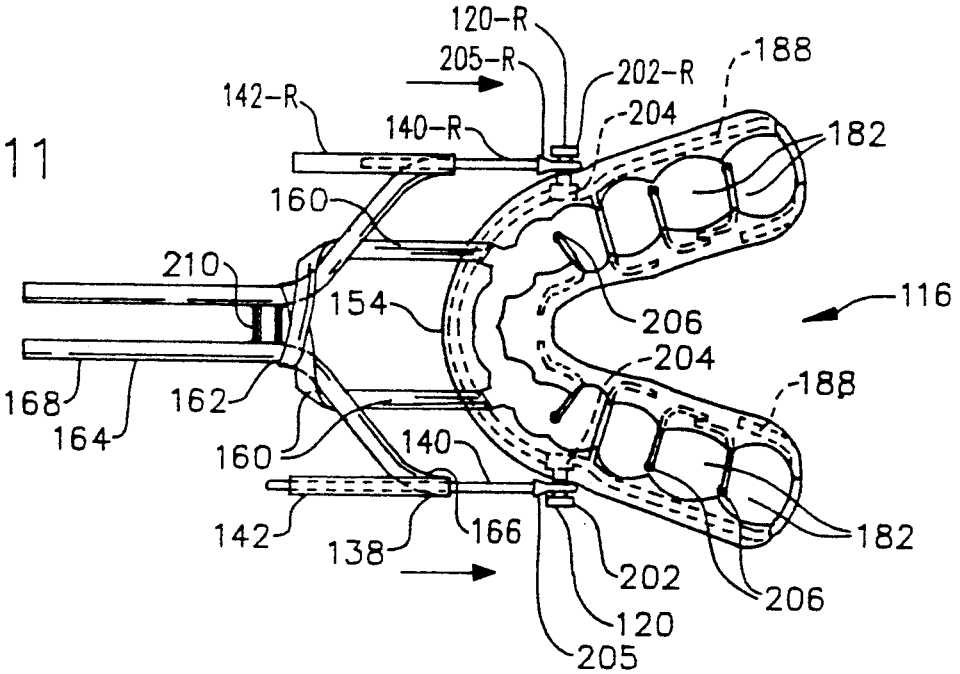
FIG. 11 is a top plan view similar to the view first shown in FIG. 10, however, in this FIG. 11, the device is shown during opening of the mouth, with the device at its most downward, rearward position.

In FIG. 10, the mandibular mold 116 is seen at its fully closed position; in FIG. 11, the fully open position is seen. Note that piston 140 is slightly longer than piston **140-*r*; that is to accommodate a clearance problem between actuator 112 and the piston 140-*r*** when in the fully closed position.

The apparatus set forth above may be utilized in a method of physical therapy for patients undergoing TMJ surgery. The apparatus as described is provided, and a variable vertical clearance between upper and lower teeth is established which increases as the patient is able to accommodate the therapy. It has been found that by regular use of my device, a patient's after surgery bite gap, the distance between the upper and lower front teeth on opening, may be increased from approximately 20 mm (as commonly achieved here to fore) to 39 mm or more. This is a great increase of TMJ mobility for patients.

The invention may be embodied in still other specific forms without departing from the spirit or essential characteristics thereof. The present embodiments are therefore to be considered in all respects as illustrative and not as restrictive, the scope of the invention being indicated by the appended claims rather than by the foregoing description; and all changes which come within the meaning and range of equivalency of the claims are therefore intended to be embraced therein.

What is claimed is:

1. An apparatus for engaging and disengaging a first member and a second member, where said first and second members each have a first end joined at, and each of which members extend outward from a substantially pivotal joint, said apparatus comprising:

(a) a base, said base comprising (i) an energizing means and (ii) a positioning means, and wherein said positioning means further comprises a fixed portion and a travelling portion, said traveling portion disposed relative to said fixed portion in a manner that said travelling portion may be cycled an adjustably desired distance relative to said fixed portion by said energizing means;

(b) a first attachment means for attachment of said first member to said fixed portion of said base, said first attachment means further comprising (i) a pin means for connection to said base, (ii) a mold adapted to snugly fit in a close fitting relationship with said first member, and (iii) a pivot means, said pivot means providing a joint between said pin means and said mold, whereby said mold may pivot about said pin means and thereby allow said first member to rotate with respect to said base;

(c) a second attachment means for attachment of said second member to said travelling portion of said base, said second attachment means further comprising (i) a pin means for connection to said base, (ii) a mold adapted to snugly fit in a close fitting relationship with said second member, (iii) an extension means, said extension means interposed between said pin means and the mold so as to allow said second attachment means to move laterally with respect to said base, and (iv) a pivot means, said pivot means providing a pivot joint between said extension means and said mold;

(d) whereby an arc of selected radius and may be traversed by said second member with respect to said first member when said energizing means cycles said traveling portion in relation to said fixed portion of said base of said apparatus.

2. An apparatus for actuating a temporomandibular joint which connects the maxillary and a mandible of a patient having upper teeth and lower teeth, said apparatus comprising:

(a) a base, said base further comprising (i) a fixed portion, (ii) a travelling portion, and (iii) energizing means for providing cyclic movement of a preselected distance between said portions;

(b) a maxillary attachment means, said means including (i) a mold adapted fit in a snug, close fitting relationship with the patient's upper teeth, and (ii)

a pivotally attached first pin means adapted for pivotally connecting said mold to said fixed portion of said base;

(c) a mandibular attachment means, said mandibular attachment means further comprising (i) a mold adapted to fit snugly in a close fitting relationship with the patient's lower teeth, and (ii) second pin means adapted to connect said mandibular attachment means to said travelling portion of said base; and (iii) an extension means, said extension means further comprising:

(A) a hollow cylinder, said cylinder attached to said second pin means; and (B) a piston adapted to fit within said hollow cylinder, said piston pivotally attached to said mold, said piston positioned in a smooth working relationship with said cylinder whereby said piston may be moved back and forth within said cylinder to guide said mandibular mold attachment means along a lateral track corresponding to the range of motion of said piston within said cylinder, so as to allow said mandibular attachment means to move laterally.

3. An actuation device for moving the temporomandibular joint of a patient through a complete opening and closing cycle of the patient's jaw, comprising:

(a) an actuation device, said actuation device having a fixed portion, a travelling portion, and an energizing mechanism for providing movement in a preselected distance between the travelling portion and the fixed portion;

(b) securing means coupled with the actuation device and adapted to secure the actuation device to the patient in an operative position;

(c) a first connection means for pivotally connecting a maxillary mold attachment means to the fixed portion of said actuation device, said maxillary mold attachment means including a mold portion and pin means portion pivotally connected;

(d) a second connection means for pivotally connecting a mandibular mold attachment means to the travelling portion of said actuation device said mandibular mold attachment means including a mold portion, a pin means portion, and an extension portion, said extension portion pivotally attached to said mold portion and permitting said second connection means to move laterally with respect to said fixed portion; and (e) energizing means for cyclically raising and lowering the said travelling portion relative to the fixed portion whereby the patient's jaw is opened and closed without the need for force by the patient.

4. The device of any one of claims 1, 2 or 3 wherein said molds are further comprised of acrylic grade plastic.

5. The device of claim 2 or 3 wherein said molds further include ball clasps, whereby said molds may be securely attached to the teeth of said patients.

6. The device of claims 2 or 3 wherein said maxillary mold is further comprised of a bottom and sidewalls, and wherein said bottom is solid.

7. The device of claims 1 or 3, wherein said extension means further comprises a piston and a cylinder adapted to fit within said cylinder and move from a closed position to an open position.

8. The device of claim 2 or 3, wherein said mandibular mold attachment means further comprises a biasing means to urge said mandibular mold attachment means toward a normally closed position.

9. The device of claim 8, wherein said biasing means is comprised of a rubber band.

10. The device of claim 9, wherein said mandibular mold attachment means further includes a front portion corresponding in position to the front teeth of said patient, and wherein said pin means further includes a central Y-portion, and wherein said rubber band is attached to said front of said mold and to said center of said y-portion of said pin means.

11. The device as set forth in claim 8, wherein said biasing means is of a size and strength so as to prevent the said piston to hollow cylinder horizontal joint from opening so far as to allow said piston to escape from said hollow cylinders during normal operation.

12. The device of claim 2 or 3 wherein said pivot joint further comprises:

a) a screw;

b) a threaded receptacle adapted to receive said screw, said threaded receptacle embedded at a suitable operating location in said mold;

c) and wherein said pin means has a proximal end for attachment to said actuator and a distal end for attachment to said pivot joint, and wherein said distal end of said pin means further includes an eye shaped structure defining a passageway large enough to allow passage of said screw therethrough, whereby said pin means is attached to said mold by fitting said screw through said passageway.

13. The device of claims 2 or 3, further comprising a pair of connection pins mounted in a spaced apart relation at a pivot joints to allows rotation of the mold about a common transverse horizontal axis.

14. The device as set forth in claims 2 or 3, wherein the cyclic raising and lowering of the travelling portion relative to the fixed portion results in a lowering of the mandible relative to the maxillary, and wherein (i) said maxillary mold attachment means may move pivotally relative to said actuation device, and (ii) said mandibular mold attachment means may move both pivotally and horizontally relative to said actuation device, whereby said mandible may move both downwardly and rearwardly upon opening, and upwardly and forwardly upon closing, during cycling of the actuation device.

15. The device as set forth in claims 2 or 3, wherein said mandibular attachment means further comprises an extension means, said extension means further comprising at least one hollow cylinder mounted near the distal end of the said pin means, said hollow cylinder adapted to receive a piston, said piston connected to said pivot and thereby to said mandibular mold attachment means.

16. The device as set forth in claims 2 or 3, wherein said mandibular attachment means further comprises a pair of hollow cylinders mounted substantially at the distal ends of said pin means, the first of said hollow cylinders is adapted to receive a first piston operatively connected to the right side of said mandibular mold, and wherein said second of said hollow cylinders is adapted to receive a second piston operatively connected to said left side of said mandibular mold.

17. A method of treatment of human patients after surgery which may affect the mobility of the temporomandibular joint, said patients having a maxillary and mandible with upper and lower teeth extending respectively therefrom, said method comprising:

(a) providing an actuator device, and securing said device in an operating position to said patient, wherein said device comprises:

(i) a base, said base further comprising (A) a fixed portion, (B) a travelling portion, and (C) energizing means for providing cyclic movement of an adjustably desired distance between said portions;

(ii) a maxillary attachment means, said means including (A) a old adapted fit in a snug, close fitting relationship with the patient's upper teeth, and (B) a pivotally attached first pin means adapted for pivotally connecting said mold to said fixed portion of said base;

(iii) a mandibular attachment means, said mandibular attachment means further comprising (A) a mold adapted to fit snugly in a close fitting relationship with the patient's lower teeth, and (B) second pin means adapted to connect said mandibular attachment means to said travelling portion of said base; and (C) an extension means, said extension means further comprising (i) a hollow cylinder, said cylinder attached to said second pin means; and (ii) a piston adapted to fit within said hollow cylinder, said piston pivotally attached to said mold, said piston positioned in a smooth working relationship with said cylinder whereby said piston may be moved back and forth within said cylinder to guide said mandibular mold attachment means along a lateral track corresponding to the range of motion of said piston within said cylinder, so as to allow said mandibular attachment means to move laterally;

(b) running said energizing means of said actuator device so as to provide cyclic motion of said temporomandibular joint.

18. The method of claim 17, wherein said cyclic motion is provided to allow up to a 39 mm gap between the upper and lower teeth of said patient.

* * * * *